United States Patent [19]

Hettinga

[11] 4,286,731

[45] Sep. 1, 1981

[54] SOAP LEAF SHEET DISPENSER

[75] Inventor: Siebolt Hettinga, De Moines, Iowa

[73] Assignee: Parachem Corporation, Des Moines, Iowa

[21] Appl. No.: 119,639

[22] Filed: Feb. 7, 1980

[51] Int. Cl.[3] ..... B65G 59/06

[52] U.S. Cl. ..... 221/259

[58] Field of Search ..... 221/259; 271/131, 165; 312/60, 61

[56] References Cited

U.S. PATENT DOCUMENTS

| | | | |
|---|---|---|---|
| 2,637,609 | 5/1953 | Berg | 221/259 X |
| 3,226,110 | 12/1965 | Greene | 221/259 X |

*Primary Examiner*—Stanley H. Tollberg

*Attorney, Agent, or Firm*—Rudolph L. Lowell; G. Brian Pingel

[57] ABSTRACT

A device that is manually actuable by a user for dispensing a plurality of soap leaf sheets one at a time includes a housing with at least a back wall, a bottom wall with a central opening, and a front wall with a dispensing slot adjacent the bottom wall. Channels are located at opposite sides of the central opening, and a dispensing member rides in the channels for movement in a parallel relation to the soap leaf sheets. The dispensing member also has limited pivotal movement transversely of the channels from a rest position in which the dispensing member is spaced from the soap leaf sheets to a moved position in which the dispensing member engages the bottom one of the sheets. A bias spring is employed for normally holding the dispensing member in the rest position, but application of a dispensing force by a user upon the dispensing member concurrently pivots such member into engagement with the bottom soap leaf sheet and linearly moves such member toward the housing front wall to convey the bottom sheet through the housing dispensing slot.

5 Claims, 9 Drawing Figures

SOAP LEAF SHEET DISPENSER

BACKGROUND OF THE INVENTION

1. Field of the Invention

The present invention relates in general to devices for dispensing individual sheets of a soap leaf material and more specifically relates to such devices that have a linearly movable dispensing member for frictionally engaging a sheet to be dispensed.

2. Description of the Prior Art

Lightweight individually sized sheets formed of a thin layer of soap have become popular as a substitute for cake or liquid soap in applications where it is convenient or necessary to dispense individual portions of a soap substance. Several types of dispensing devices have been developed and used in the past for the convenient dispensing of these lightweight soap sheets one at a time, as disclosed in Greene U.S. Pat. Nos. 3,151,771; 3,226,110 and 3,051,352.

In Greene U.S. Pat. No. 3,151,771, soap leaf sheets are arranged in a stacked relation in a carton which is disposed in an enclosure housing. The housing has a bottom end opening by which the bottom sheet of the stack of sheets is exposed so that a user can press a finger or fingers against such sheet and withdraw it from its carton.

In Greene U.S. Pat. Nos. 3,051,352 and 3,226,110, a carton of stacked sheets is also employed inside a housing. However, in contrast to the structure of Greene U.S. Pat. No. 3,151,771, the structures of both of these later Greene patents include roller type dispensing devices that are rotated to engage the bottom sheet of a stack of soap leaf sheets and dispense it through a slot in the housing.

the present invention differs from each of the above-described structures by employing a linearly slidable and pivotal dispensing member for engaging a sheet to be dispensed such that in a simple one-step operation, it is insured that an individual soap leaf sheet will be dispensed from its enclosure housing.

SUMMARY OF THE INVENTION

The present invention provides a device that is manually actuable by a user for dispensing soap leaf sheets one at a time from an enclosure housing, which device includes a manually actuable linearly sliding dispensing member engageable with the sheets one at a time for discharge through a slot in the housing.

The housing is mountable upon a wall and includes at least a back wall, a bottom wall with a central opening and a front wall with a dispensing slot adjacent the bottom wall. A plurality of soap leaf sheets are arranged in a stacked relation within the housing whereby a bottom sheet of the stack is faced toward the housing bottom wall. Channel means are associated with the bottom wall on opposite sides of the central opening in a parallel relation to the bottom sheet. The dispensing means rides in such channel means for movement in both parallel and transverse directions with respect to the stack of sheets to dispense the bottom sheet.

Normally, the dispensing means is disposed in a rearward rest position out of engagement with the soap leaf sheets. However, upon application of a dispensing force by a user, the dispensing means is concurrently pivoted into engagement with the bottom soap leaf sheet and then linearly moved forwardly to dispense the sheet from the dispensing slot in the front wall of the housing.

To provide for such pivotal and linear movements of the dispensing means, such means has a main portion with guide means protruding from opposite sides thereof for riding in the channel means. Each of the guide means is of a generally airfoil shape in transverse cross-section so as to have a front portion movable transversely of and within the channel means and a back portion slidably moveable therein whereby the dispensing means is tiltable within the transverse confines of the channel means. The dispensing means is normally held in a rearward rest position by a bias means. However, such bias means is easily overcome by application of a forwardly directed manual force on the dispensing means to pivot the dispensing means into engagement with the bottom sheet and then move it linearly forwardly for discharge from the housing.

Thus, the present invention provides an efficient and convenient means for dispensing individual soap leaf sheets from a housing one at a time in a simple and convenient operation that insures that only one sheet will be dispensed on each actuation of the dispensing means.

DESCRIPTION OF THE PREFERRED EMBODIMENT

Figure 1:
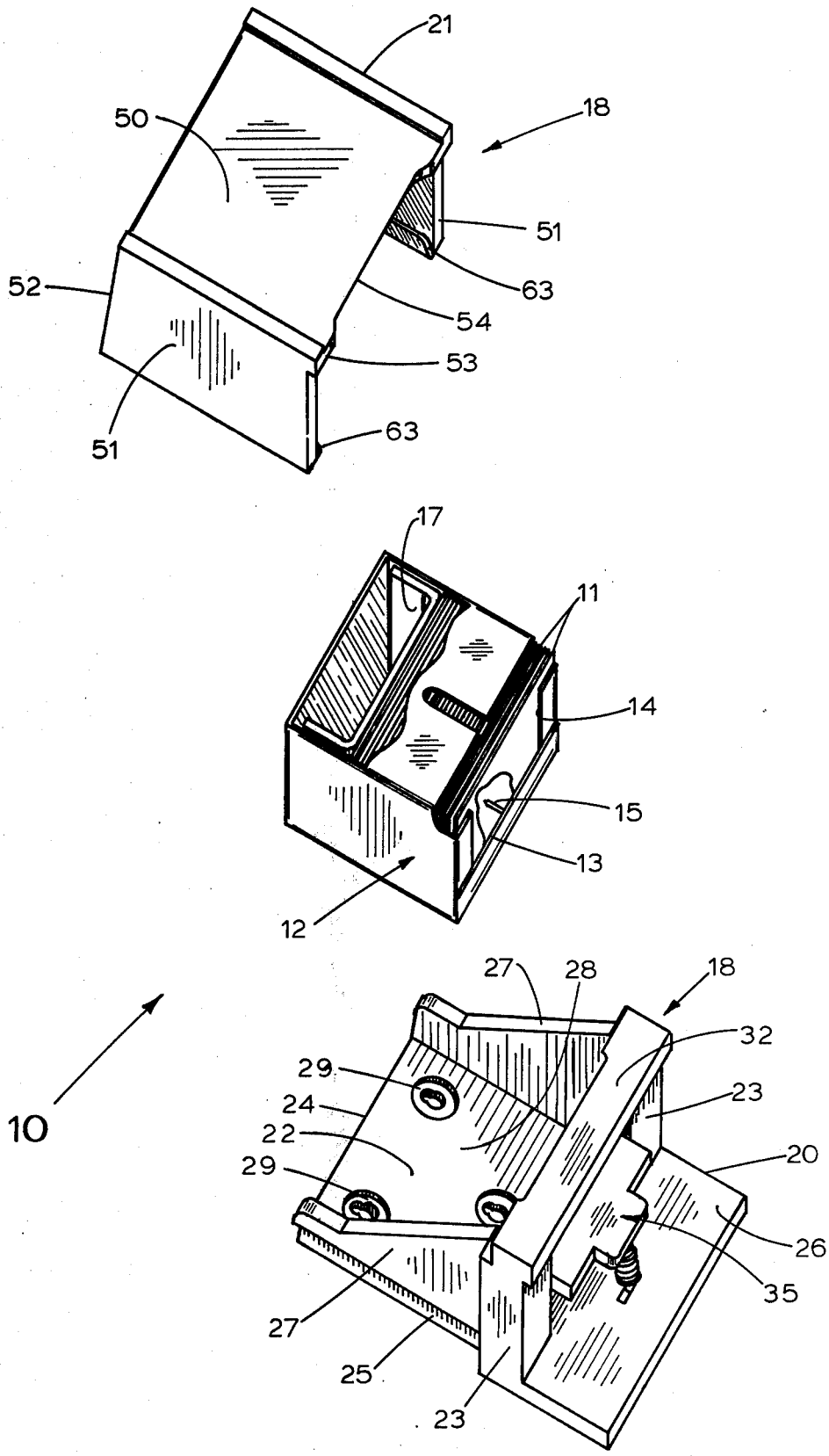
FIG. 1 is an exploded front perspective view of a soap leaf sheet dispensing device of the present invention with portions cut away to show internal construction.

A preferred embodiment of the dispenser of the present invention is shown in FIG. 1 at 10 and is particularly adapted to provide a durable, efficient and convenient means for dispensing soap leaf sheets 11 one at a time from a carton 12 that holds a plurality of stacked sheets 11. The soap leaf sheets 11 are well known in the art and are employed as a substitute for cake or liquid soap wherever convenient or necessary to dispense an individual portion of soap. The sheets 11 are each formed of a thin, lightweight layer of soap of the type described in Anderson U.S. patent application Ser. No. 762,938 filed Sept. 24, 1958, now abandoned after being replaced by continuation-in-part application Ser. No. 316,514, filed Oct. 16, 1963.

Although it would be possible to arrange the sheets 11 in a stacked relation without use of the carton 12, it is highly preferably for purposes of refilling and effective operation of the dispenser 10 that the carton 12 be employed. The carton 12 is also well known in the art and is of a construction as described in Greene U.S. Pat. No. 3,226,110, issued Dec. 28, 1965, entitled "Leaf Dispenser" and incorporated herein in its entirety by reference.

The carton 12 is preferably formed of a paper board material and has a bottom end 13 that is partially open at 14 to expose a portion of the bottom surface of the lowermost end sheet 11 and to provide an exit means for removal of the sheets 11 from the carton 12. The bottom carton end 13 also has a retaining needle 15 (FIG. 5) that is extended upwardly through several of the bottom sheets 11 for a purpose to be described later. Referring again to FIG. 1, to urge the lightweight sheets 11 toward the bottom of the carton 12 as the sheets 11 are removed one at a time, a weight 17 is dispensed in the carton 12 to sit on top of the sheets 11.

Figure 5:
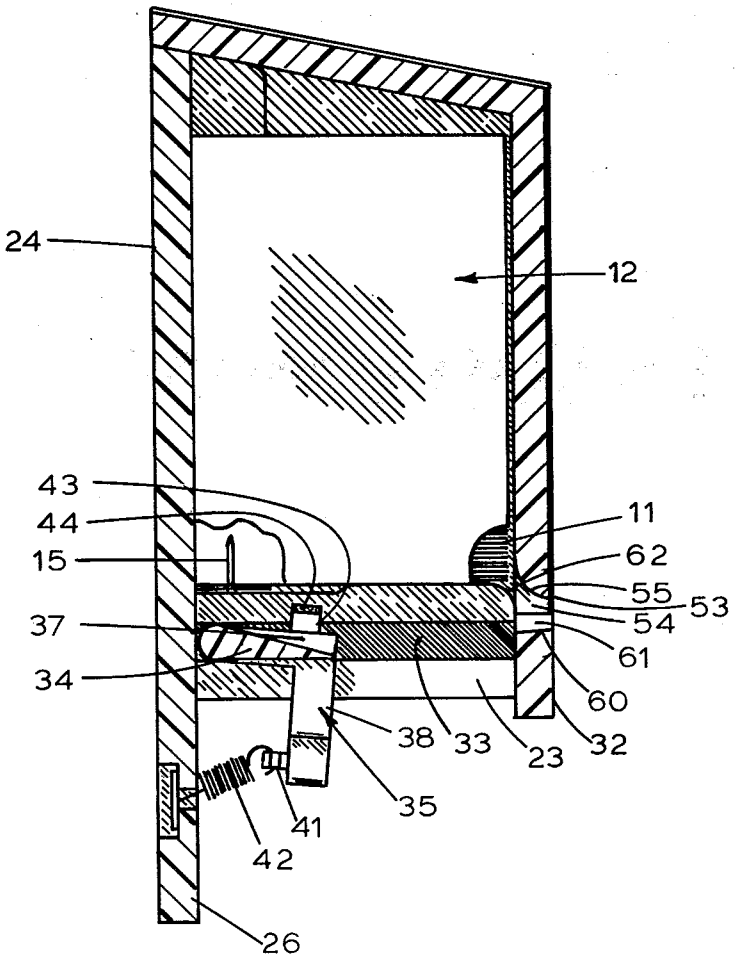
FIG. 5 is a cross-sectional view of the dispensing device of FIG. 1 taken along the line 5—5 of FIG. 2.

The dispenser 10 includes a durable high strength plastic or composition material housing 18 having a back wall 20 and a cover 21. The back wall 20 has an upper section 22 and a lower section 26 having at their junction a pair of transversely spaced arms 23 that extend forwardly from the back wall 20 to serve essentially as a support for the carton 12 and cover 18. The arms 23 are braced from the back wall 20 by associated gusset members 27 which are cut away, as indicated at 25, to form upright side notches for interfitting engagement with mating portions 63 on the cover 18. The back wall 20, arm members 23 and gusset members 27 are of one piece to form a receiving area 28 for the carton 12 which rests on the upper sides of the arms 23 (as shown in FIG. 5). For ready mounting of the dispenser 10 on a wall, the back wall 22 has several screw receiving holes 29 (FIG. 1).

Figure 3:
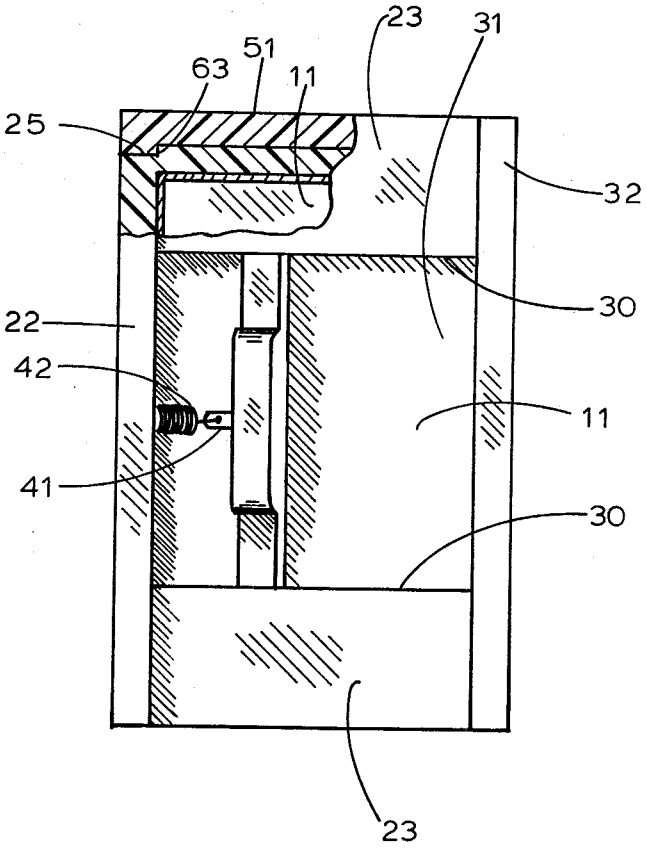
FIG. 3 is an enlarged bottom view of the dispensing device of FIG. 1 with a portion broken away.
Figure 4:
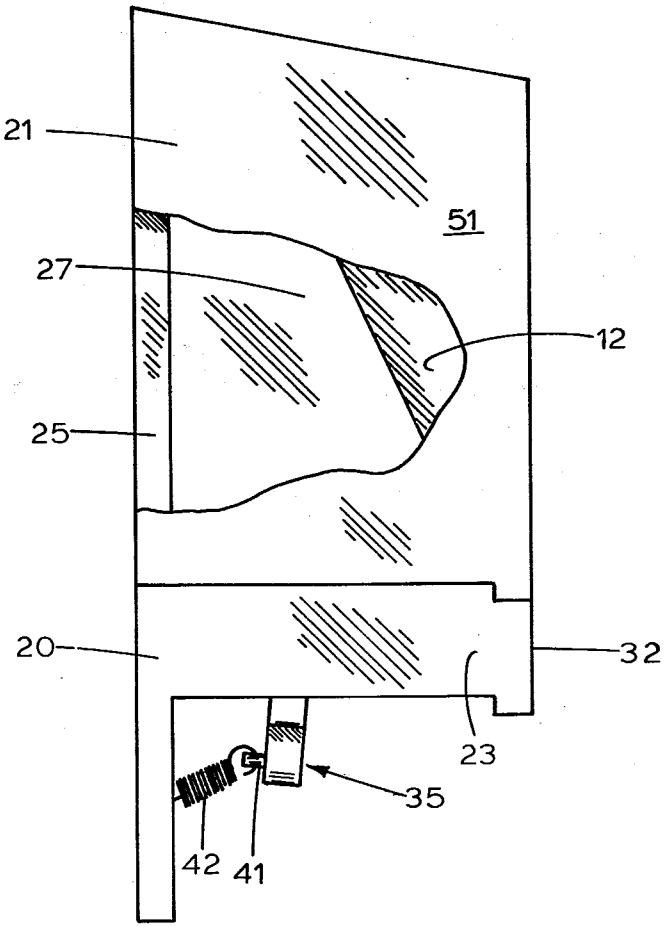
FIG. 4 is an enlarged side view of the dispensing device of FIG. 1 with a portion broken away.

The forward ends of the arms 23 are connected together by a brace or head member 32 so that the inner sides 30 of the arms, the back wall 20 and head member 32 form a rectangularly shaped central opening 31 (FIG. 3). The inner sides 30 of the arms 23 are formed with channel shaped grooves 33 (FIG. 5) to provide linear guideways for guide members 34 (FIG. 6) of a sheet dispensing member 35 that is slidable in the guideways 33.

Figure 6:
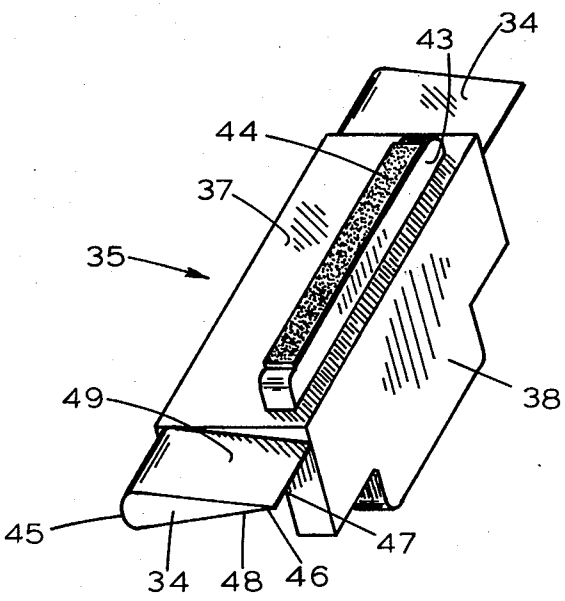
FIG. 6 is a side perspective view of a dispensing means employed in the dispensing device of FIG. 1.

Referring to FIGS. 5 and 6, the dispensing member 35 is of a right angle shape having a generally horizontal leg 37 and a downwardly extended generally vertical leg 38. The back side of the leg 38 has a node 41 for attachment of one end of a relatively weak spring 42, the opposite end of which is attached to the back wall lower portion 26 to serve as a bias means for moving the dispensing member 35 in a rearward direction. Projecting upwardly from and longitudinally of the dispensing member leg 37 at a position near the forward end thereof, is a sheet engaging abutment member 43, the upper side of which is covered with a thin layer of abrasive material 44.

The guide members 34 (FIG. 6) project from opposite sides of the horizontal leg 37 and into the guideways 33 and are of a length approximately equal to the transverse dimension of the leg 37. Each of the guide members 34 is of a wing or airfoil shape in transverse cross section with a rear end 45 of a thickness substantially equal to the width of the guideways 33, and feathering to a front end 46 so as to terminate in an acute front apex 47. Thus, the apices 47 of the guide members 34 have a limited movement transversely of the guideways 33 and the guide member rear ends 45 are slidably movable within the guideways. As a result, the dispensing member 35 has a limited amount of pivotal or tiltable movement about the rear ends 45 of the guide members 34 defined by engagement of the side walls thereof with the sidewalls of the guideways 33.

Figure 7:
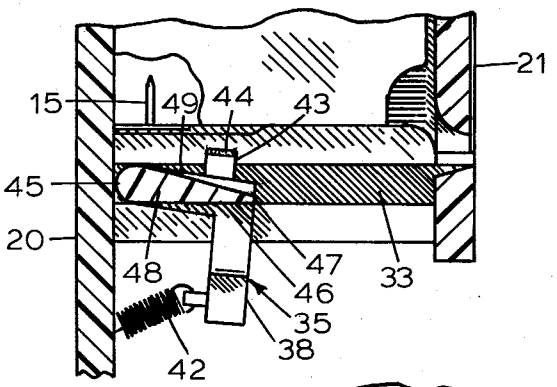
FIG. 7 is a diagrammatic fragmentary side view similar to FIG. 5 but showing only the bottom portion of the dispensing device of FIG. 1 with the dispensing means arranged in a rearward rest position.
Figure 8:
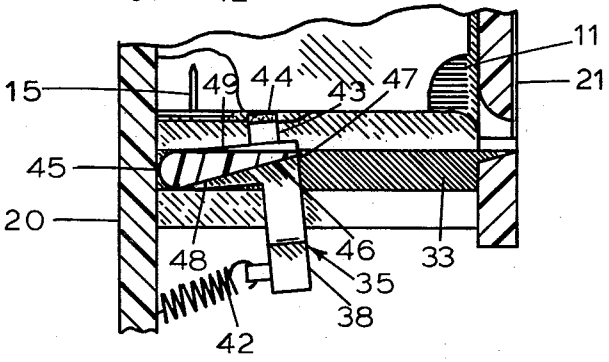
FIG. 8 is a view similar to FIG. 7 showing the dispensing means pivotally moved from the rest position into engagement with a soap leaf sheet.

Normally, the biasing spring 42 holds the dispensing member 35 against the housing rear wall 22 and in a downwardly and forwardly inclined rest position wherein the lower side walls 48 of the guide members 34 are engaged with the lower sides of the guideways 33, and the sheet engaging abutment member 43 is entirely out of contact with the lowermost one of the sheets 11 (FIGS. 5 and 7). However, a forwardly directed pressure exerted on the vertical leg 38 acts to initially pivot the dispensing member 35 in an upward direction about the rear ends 45 of the guide members 34 so that the abrasive material 44 on the abutment 43 lightly contacts the bottom sheet 11 (FIG. 8) before there is any appreciable forward movement of the member 35. This leaf contacting position of the abutment member 43 is defined by the engagement of the upper side walls 49 of the guide members 34 with the upper sides of guideways 33 (FIG. 8).

Figure 9:
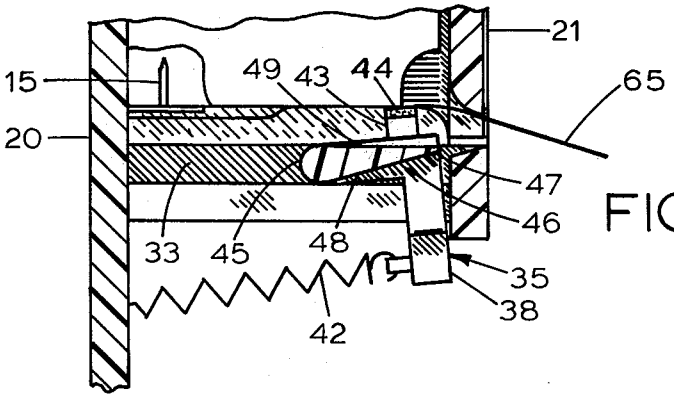
FIG. 9 is a view similar to that of FIG. 8 showing the dispensing member moved linearly forward while in engagement with the soap leaf sheet to dispense the sheet from a housing of the dispensing device.

Thereafter, as the member 35 continues its forward movement in response to the forwardly directed force, the bottom sheet 11 is stripped from the needle 15 and moved from beneath the remaining sheets 11 and outwardly from the housing as indicated by the sheet 65 in FIG. 9. Since the needle 15 projects upwardly through several of the lower sheets 11 such sheets 11 are retained in the carton 12 as the lowermost sheet 65 moves forwardly with the abutment member 43 because the force required to tear such sheets 11 from the retaining needle 15 is greater than the forward force applied on such sheets by the abutment member 43.

Figure 2:
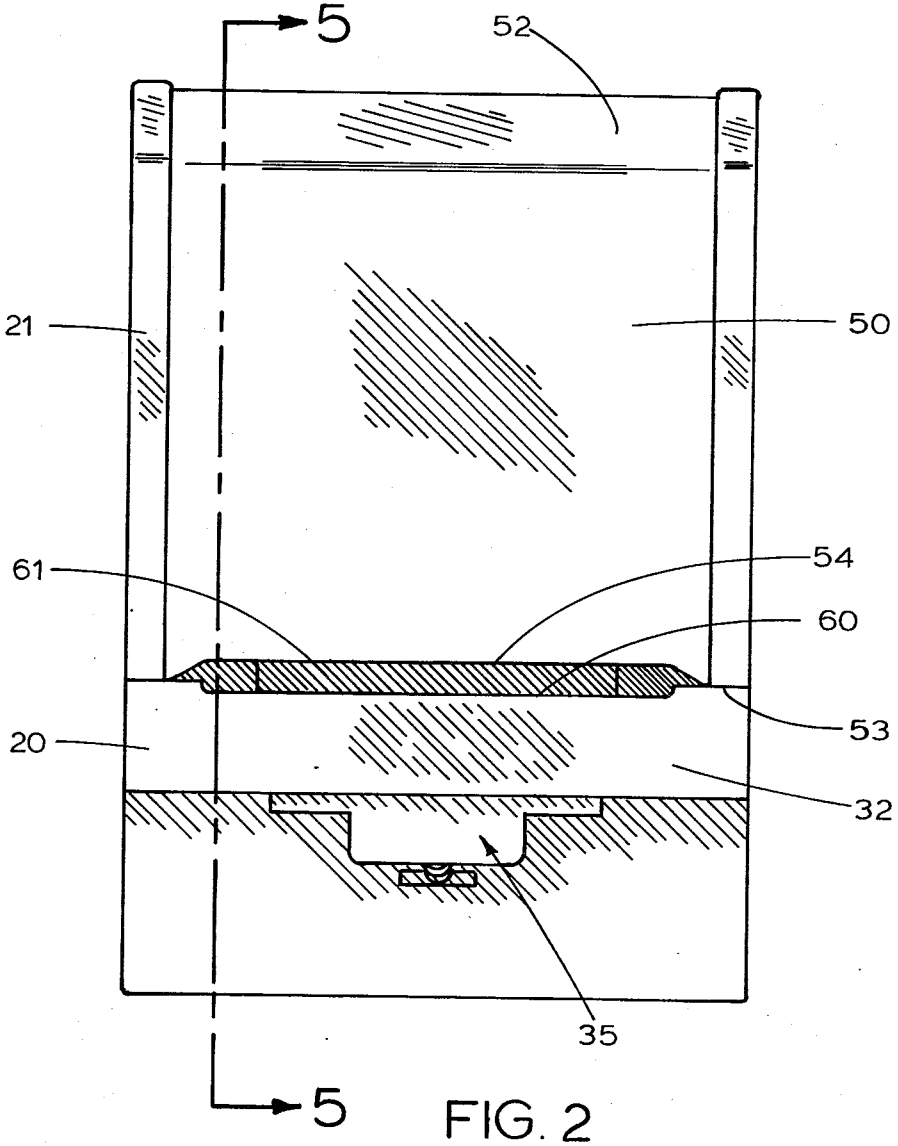
FIG. 2 is an enlarged front view in elevation of the dispensing device of FIG. 1.

Referring again to FIG. 1, the housing cover 21 includes a generally flat front wall 50, a pair of side walls 51 and an inclined top wall 52. As indicated in FIGS. 1 and 5, the bottom end 53 of the front wall 50 is formed with a shallow portion 54 having a curved upper edge portion 55 (FIG. 5). The transverse head member 32 on the arms 23 has a corresponding recessed portion 60 opposite the recessed portion 54, so that the two recessed portions 54 and 60 form a slot 61 (FIG. 2) through which soap leaf sheets are dispensed from the housing 18 by action of the dispensing member 35, as indicated in FIGS. 7, 8 and 9.

To aid in such sheet dispensing, the top front edges of the arms 23 each has a curved tapered portion 62 (FIG. 5) which coacts with the curved tapered edge 55 of the cover front wall to make certain that the lowermost sheet 65 will be guided into the slot 61 as it is moved forward by the dispensing member 35 for discharge as shown in FIG. 9.

Referring to FIGS. 1 and 3, to interlock the cover 21 on the rear wall 20, the mating portions 63 are moved into a nested relation with the notches 25. Thus, to assemble the cover 21 and rear wall 20, the cover 21 is moved downwardly of the back wall 20 until the side walls 51 and front wall 50 of the cover 21 abut against the arms 23 and the head member 32, respectively, to form an enclosing housing for the soap leaf carton 12.

Thus, the dispenser 10 of the present invention provides a convenient and durable means for efficiently and effectively dispensing lightweight individual soap leaf sheets upon actuation by a user.

Although the invention has been described with respect to a preferred embodiment thereof, it is to be understood that it is not to be so limited since changes and modifications can be made therein which are within the full intended scope of this invention as defined by the appended claims.

I claim:

1. A device for manually dispensing soap leaf sheets comprising:

(a) a housing having at least a back wall, a bottom wall with a central opening, a front wall with a dispensing slot adjacent said bottom wall;

(b) a plurality of soap leaf sheets arranged in a stacked relation within said housing with the lowermost sheet of said stack faced toward the bottom wall of said housing;

(c) guideway means on said bottom wall at opposite sides of said central opening;

(d) dispensing means having a body portion with an upright abutment member, (e) guide means at opposite sides of said body portion movable in said guideway means for guidable movement of said dispensing means between a rearward rest position, wherein said abutment member is out of engagement with said lowermost sheet, and a forward sheet dispensing position, each of said guide means having a front portion and a rear portion and of a shape in transverse cross section providing for a tiltable movement of said guide means about the rear portion thereof within the transverse dimension of a guideway means, whereby said dispensing means is tiltable upwardly and forwardly in the rest position therefor for engagement of said abutment member with the lowermost one of said sheets, (f) bias means for normally holding said dispensing means in said rest position, and (g) manually engageable means on the body portion of said dispensing means for applying a forwardly directed force on said dispensing means to concurrently tilt said dispensing member to move said abutment member into contact engagement with said lowermost sheet and to move said dispensing member to said forward position to dispense said sheet through the slot in said housing front wall.

2. A device according to claim 1 including:

(a) a container for said plurality of soap leaf sheets having an open bottom end to expose the bottommost sheet for engagement by said abutment member.

3. A device according to claim 1, wherein:

(a) said dispensing means body portion is of a right angle shape having a horizontal leg section and a vertical leg section, said guide means projected laterally from opposite ends of said horizontal leg; and (b) said manually engageable means is comprised of said vertical leg section of said dispensing means.

4. A device according to claim 2 including:

(a) means adjacent said open bottom end for maintaining the sheets above said lowermost sheet from being dispensed with said lowermost sheet.

5. A device according to claim 1, wherein:

(a) each of said guide means is of a generally airfoil shape in transverse cross section having a front portion; an apex form, and (b) said bias means is comprised of an expandable and retractable member extended between and connected to said back housing wall and said manually engagable means.

* * * * *